US010312606B1

(12) United States Patent
Wu

(10) Patent No.: US 10,312,606 B1
(45) Date of Patent: Jun. 4, 2019

(54) CABLE FASTENING TERMINAL BLOCK

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/039,306

(22) Filed: Jul. 18, 2018

(51) Int. Cl.
*H01R 4/30* (2006.01)
*H01R 4/36* (2006.01)
*H01R 9/24* (2006.01)

(52) U.S. Cl.
CPC ..... *H01R 4/305* (2013.01); *H01R 4/304* (2013.01); *H01R 4/36* (2013.01); *H01R 9/2416* (2013.01)

(58) Field of Classification Search
CPC ..... H01R 4/305; H01R 4/304; H01R 4/36; H01R 9/2416
See application file for complete search history.

(56) References Cited

U.S. PATENT DOCUMENTS 3,715,707 A * 2/1973 Anderson ..... H01R 9/16 439/721
4,040,701 A * 8/1977 Gressitt ..... H01R 4/2433 439/405
4,070,086 A * 1/1978 Trafford ..... H01R 4/363 439/717
4,669,806 A * 6/1987 Fuchs ..... H01R 4/363 439/712
4,734,061 A * 3/1988 Randall, Jr. ..... H01R 13/5216 439/709
5,203,716 A * 4/1993 Martucci ..... H01R 4/2466 439/411
7,404,745 B1 * 7/2008 Wu ..... H01R 4/26 439/709
8,105,118 B2 * 1/2012 Claprood, Jr. ..... H01R 4/304 439/709

* cited by examiner

*Primary Examiner* — Briggitte R. Hammond
(74) *Attorney, Agent, or Firm* — Chun-Ming Shih; HDLS IPR Services

(57) ABSTRACT

A cable fastening terminal block (10) used for a cable (100) includes a base (1), a fastening terminal member (2), and a screw (3). The base (1) includes an opening hole (11) and a through hole (12) formed alternatively and connected with each other. The fastening terminal member (2) is received inside the base (1) and corresponding to the opening hole (11) and the through hole (12). The fastening terminal member (2) includes a terminal slab (21) having a top end (211) formed of an engagement portion (22) extended along the opening hole (11) axially and a guiding extension piece (23) extended along the through hole (12) axially. The cable (100) penetrates through hole (12) and is placed on the guiding extension piece (23). The screw (3) penetrates opening hole (11) and is engaged with engagement portion (22). The screw (3) and the guiding extension piece jointly clamp the cable.

7 Claims, 7 Drawing Sheets

CABLE FASTENING TERMINAL BLOCK

BACKGROUND OF THE INVENTION

Field of the Invention

The present invention is related to a terminal block, and in particular to a cable fastening terminal block.

Description of Related Art

A traditional cable fastening terminal block mainly utilizes a screw and a terminal slab to jointly clamp and fasten a cable, followed by using one end of the terminal slab to electrically connect with a circuit and another end thereof electrically connected to other electronic component parts in order to achieve the effect of electrical connection between the circuit and other electronic component parts.

However, the aforementioned cable fastening terminal block is found to have the following drawbacks. Since the shape of the terminal slab is a thin slab, during the process of using a screw to fasten the cable, the terminal slab can cause the contact surface between the circuit and the terminal slab to be too small due to the relatively thin thickness of the terminal block. Consequently, the cable is likely to be cut by the terminal such that bending or rupture of cable may occur, leading to the increase of improper electrical connection between the circuit and the terminal slab.

In view of above, the inventor seeks to overcome the aforementioned drawbacks associated with the currently existing technology after years of research and development along with the utilization of academic theories, which is also the objective of the development of the present invention.

SUMMARY OF THE INVENTION

The present invention provides a cable fastening terminal block, which utilizes a top end of a terminal slab and a guiding extension piece extended therefrom in order to increase the contact area between the cable and the terminal slab; therefore, the proper electrical connection between the cable and the terminal slab.

In an exemplary embodiment of the present invention, the present invention provides a cable fastening terminal block, used for at least one cable, and the cable fastening terminal block, comprising: a base having at least one opening hole and at least one through hole formed thereon from an external toward an internal thereof, arranged alternating from each other and connected to each other; at least one fastening terminal member received inside the base and arranged corresponding to the opening hole and the through hole; the fastening terminal member having a terminal slab, and a top end of the terminal slab having an engagement portion extended along the opening hole in an axial direction thereof and a guiding extension piece extended along the through hole in an axial direction thereof; the cable penetrating through the through hole and placed on the guiding extension piece: and at least one screw penetrating through the opening hole and engaged with the engagement portion; the screw and the guiding extension piece jointly clamp the cable thereon.

In view of the above, the top end of the terminal slab includes the guiding extension piece extended therefrom such that the contact area between the cable and the terminal slab is increased. Consequently, it can overcome the drawback of bending or rupture of the cable due to the cutting by the terminal caused by the overly thin thickness of the terminal slab. As a result, the proper electrical connection between the cable and the terminal slab can be enhanced in order to allow the cable fastening terminal block to have a stable electrical connection capability.

DETAILED DESCRIPTION OF THE INVENTION

The following provides a detailed technical content of the present invention along with the accompanied drawings. However, the accompanied drawings are provided for reference and illustrative purpose only such that they shall not be used to limit the scope of the present invention.

Figure 1:
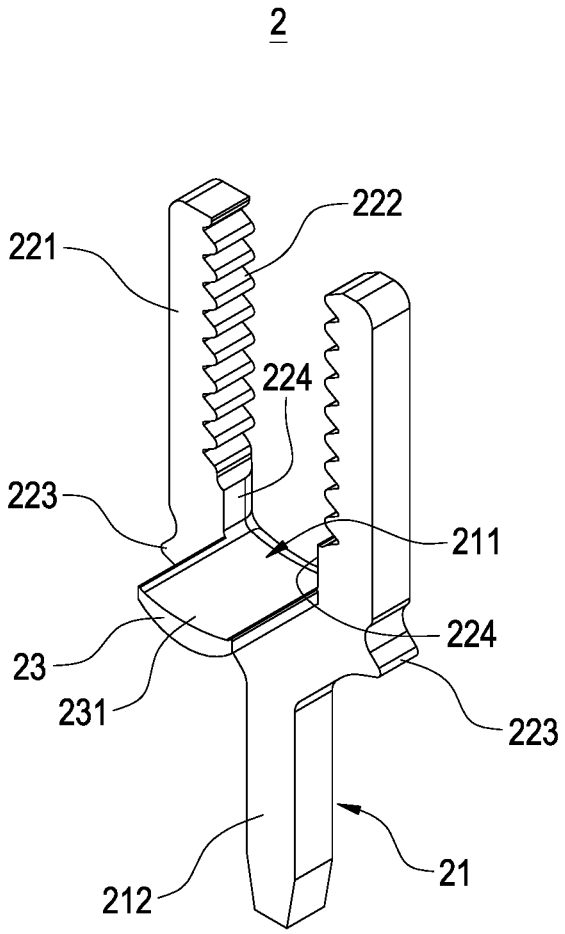
FIG. 1 is perspective view of the cable fastening terminal block of the present invention.
Figure 2:
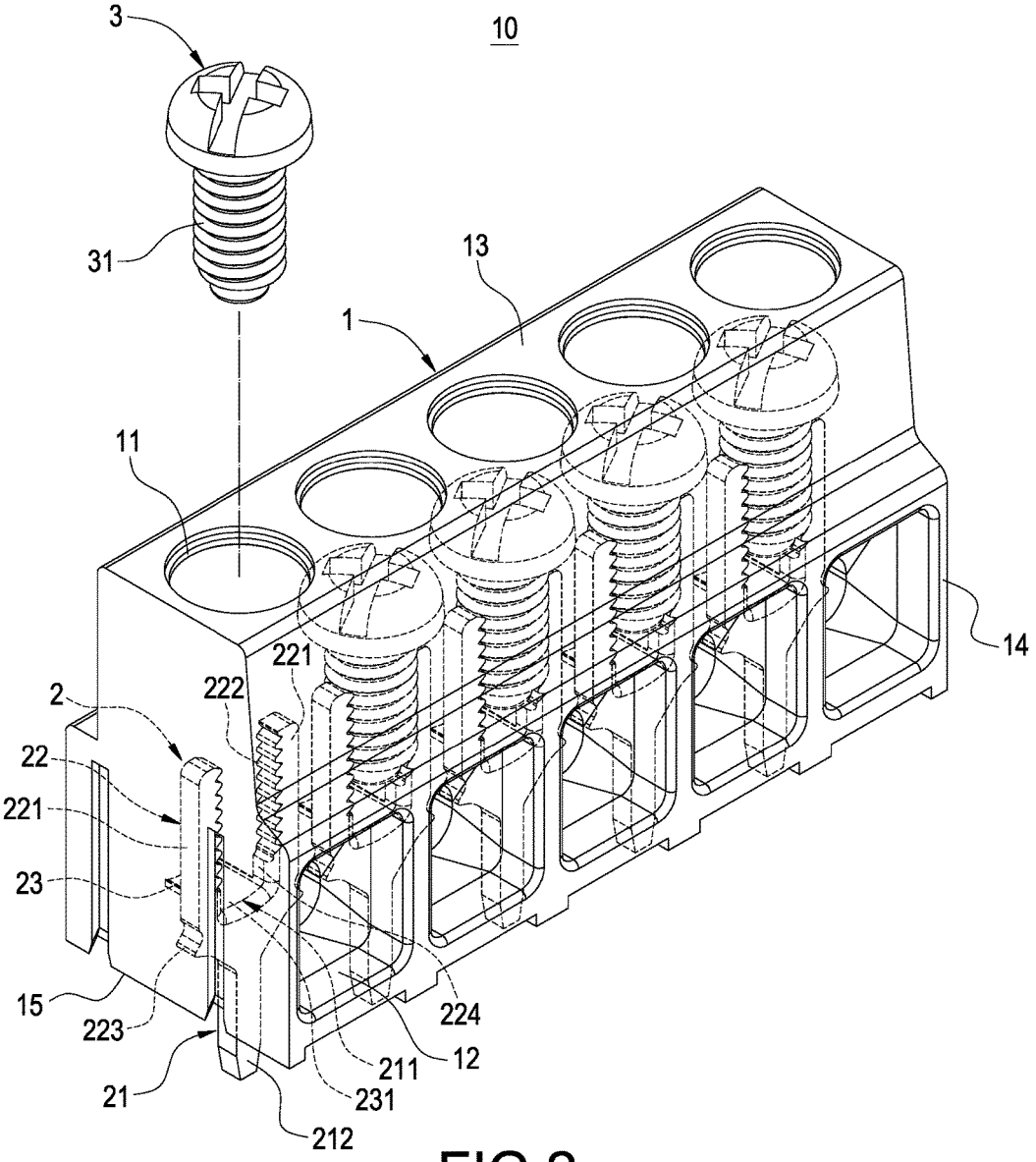
FIG. 2 is a perspective exploded view of the cable fastening terminal block of the present invention.
Figure 3:
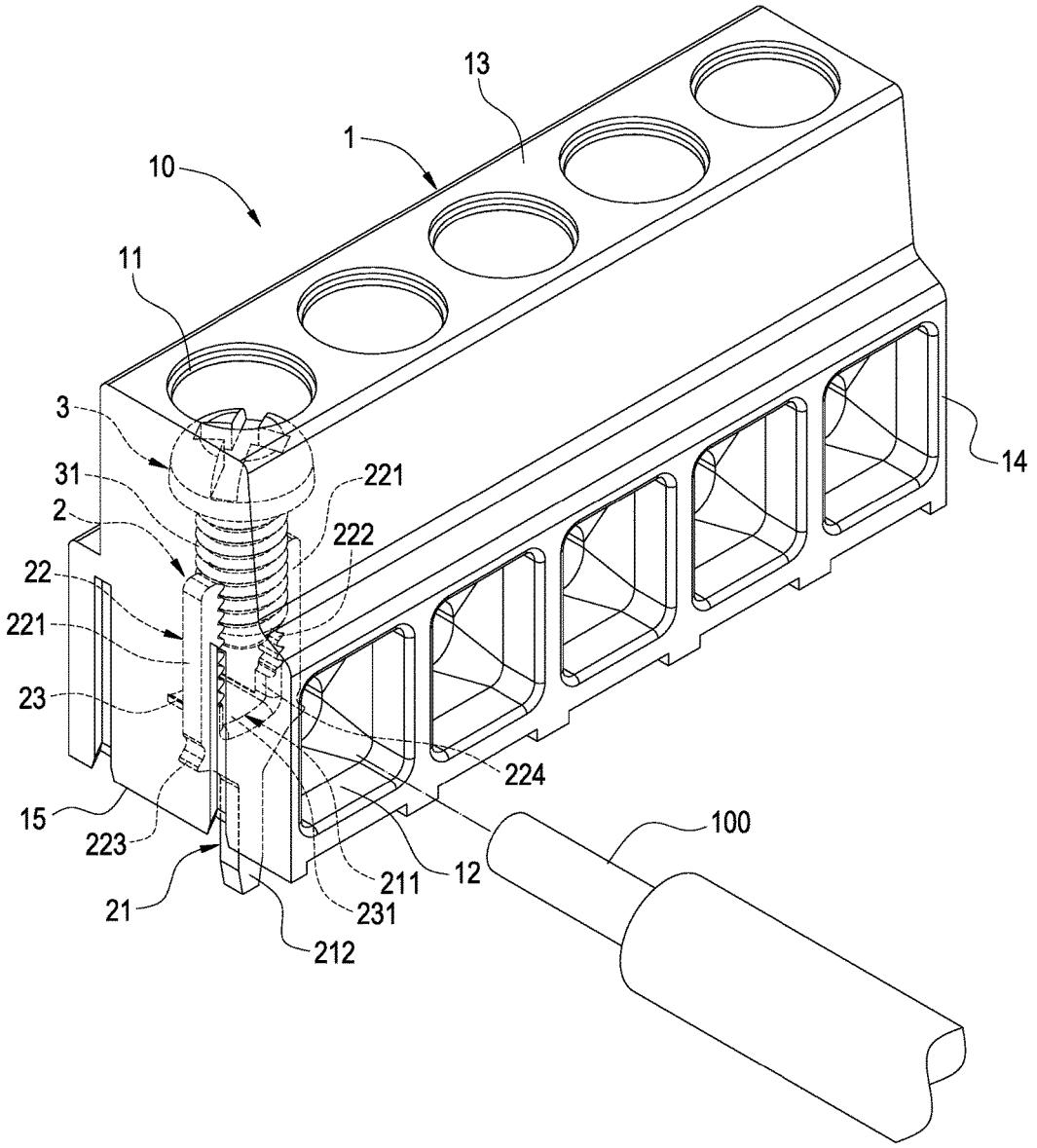
FIG. 3 is a first state of use schematic view of the cable fastening terminal block of the present invention.
Figure 4:
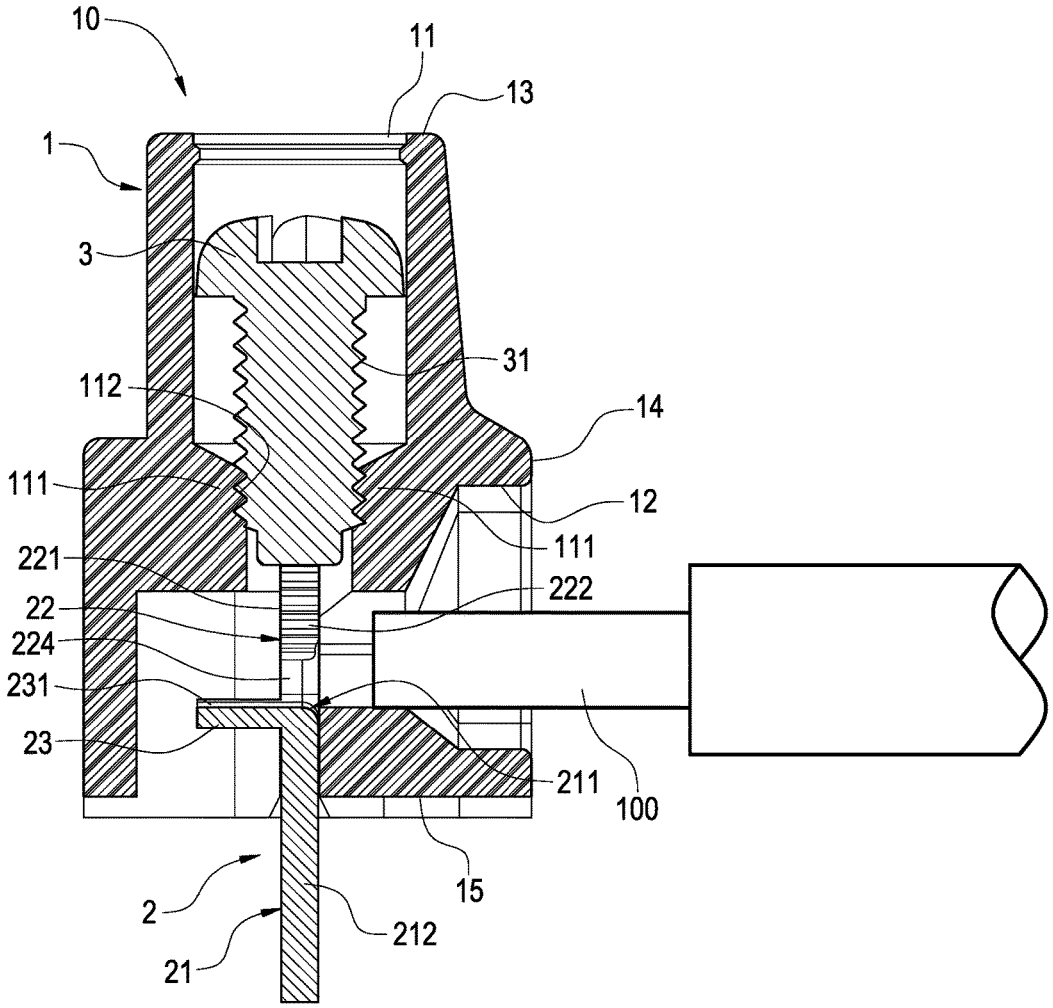
FIG. 4 is a first cross sectional view of the cable fastening terminal block of the present invention.
Figure 5:
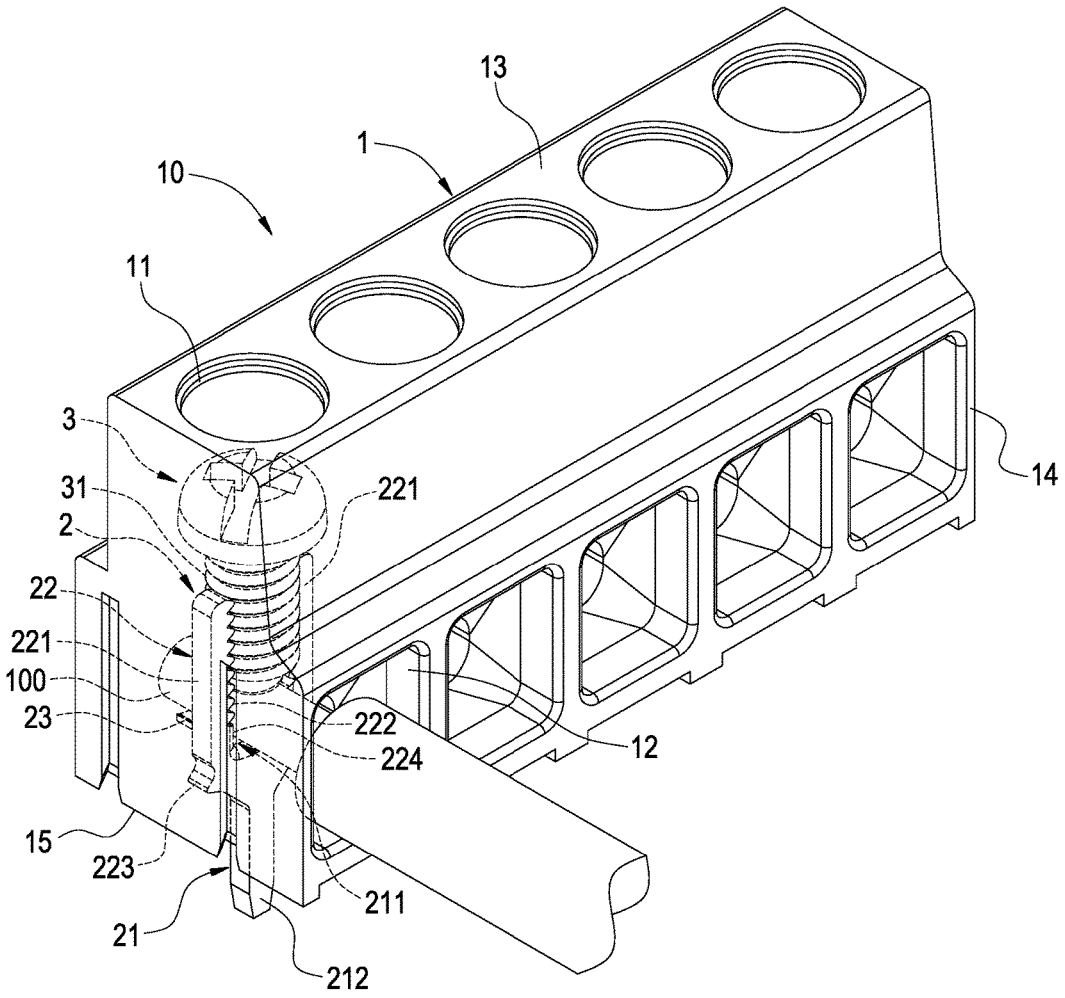
FIG. 5 is a second state of use schematic view of use the cable fastening terminal block of the present invention.
Figure 6:
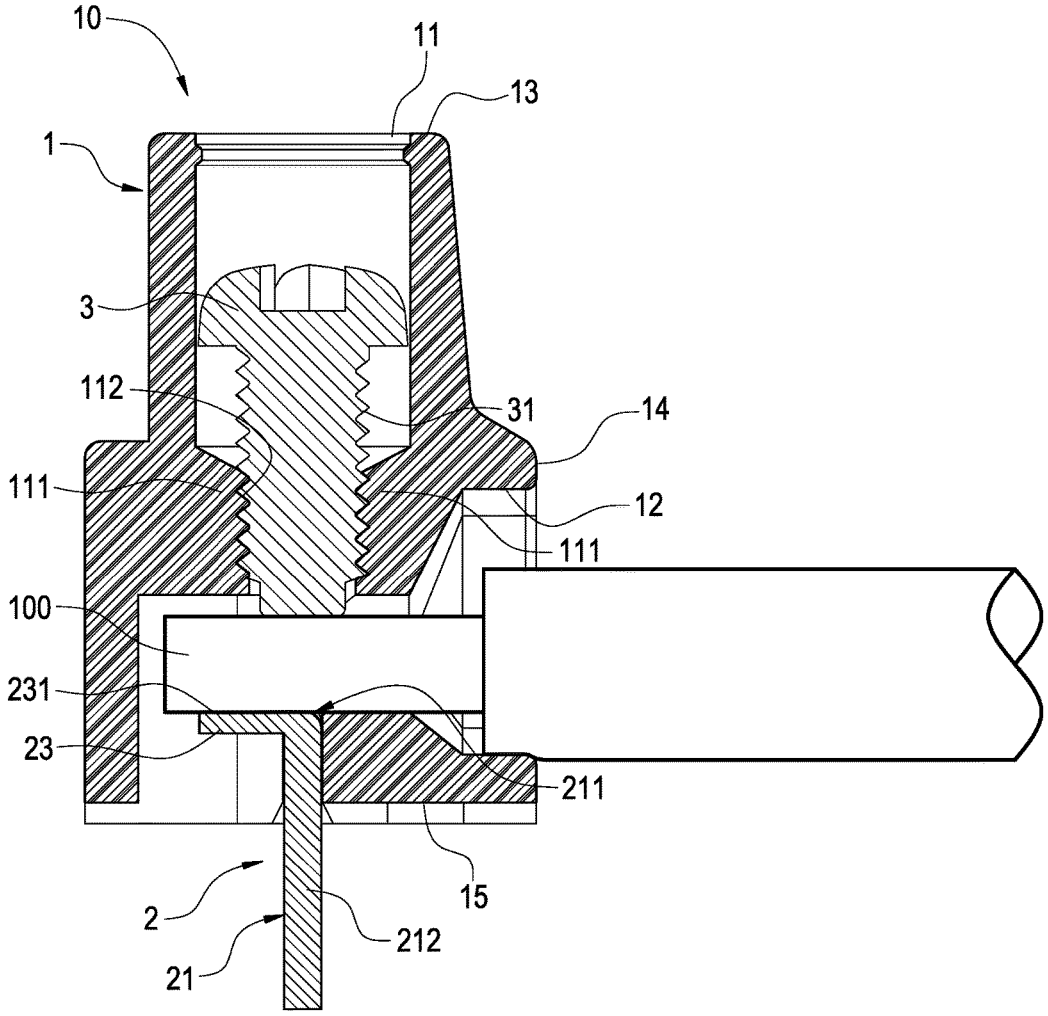
FIG. 6 is a second cross sectional view of the cable fastening terminal block of the present invention.
Figure 7:
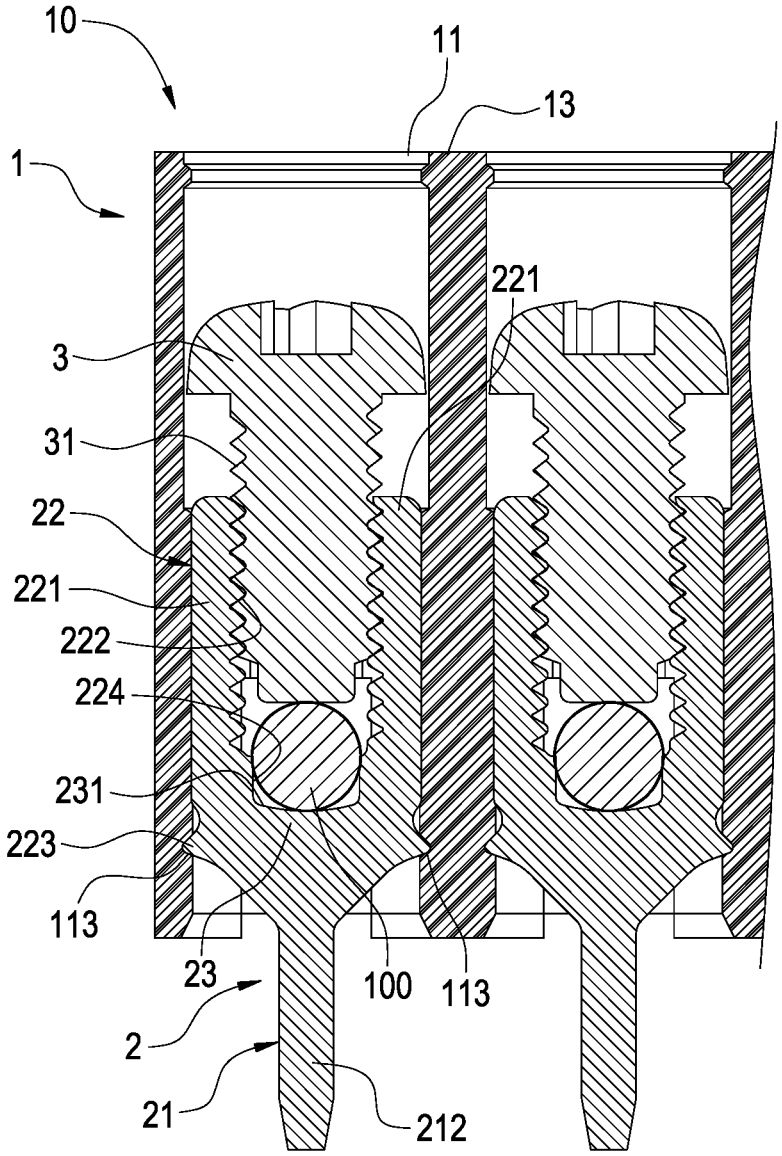
FIG. 7 is a third cross sectional view of the cable fastening terminal block of the present invention.

Please refer to FIG. 1 to FIG. 7. The present invention provides a cable fastening terminal block, used for one or a plurality of cables 100. The cable fastening terminal block 10 mainly comprises a base 1, one or a plurality of fastening terminal members 2 and one or a plurality of screws 3.

As shown in FIG. 2 to FIG. 7, the base 1 includes one or a plurality of opening holes 11 and one or a plurality of through holes 12 formed thereon from an external toward an internal thereof, arranged alternating from each other and connected with each other. In addition, the quantities of the opening hole 11, through hole 12, fastening terminal member 2 and screw 3 are the identical with each other. In addition, in this exemplary embodiment, the quantities of the opening hole 11, through hole 12, fastening terminal member 2 and screw 3 are plural; however, the present invention is not limited to such configuration only.

The following provides further details. The base 1 includes a top surface 13, a plurality of side surfaces 14 and a bottom surface 15. Each opening hole 11 is formed on the top surface 13, and each through hole 12 is formed on one of the plurality of side surfaces 14.

In addition, an inner wall of each opening hole 11 includes two protrusions 111 extended therefrom, an inner side of each of the two protrusions 111 includes a first inner threaded portion 112, and an inner wall of each opening hole 11 further includes two locking slots 113.

As shown in FIG. 1 to FIG. 7, each fastening terminal member 2 is received inside the base 1 and is arranged corresponding to the opening hole 11 and the through hole 12. Each fastening terminal member 2 includes a terminal slab 21. A top end 221 of each terminal slab 21 includes an engagement portion 22 extended along each opening hole 11 in an axial direction thereof and a guiding extension piece 23 extended along each through hole in an axial direction thereof. Each guiding extension piece 23 includes a concave inner surface 231. Each cable 100 penetrates into each through hole 12 and is placed on each guiding extension piece 23. Each concave inner surface 231 uses its shape to cooperate with the cable 100 in order to be more firmly attached onto each cable 100.

The following provides further details. Each engagement portion 22 includes two engagement shafts 221 extended from the top end 211 of the terminal slab 21 and penetrated into the opening hole 11. Each of the two engagement shafts 221 is arranged on two sides of each guiding extension piece 23, and each of the two protrusions 111 is arranged on two sides of each of the two engagement shafts 221. An inner side of each of the two engagement shafts 221 is formed of a first second inner threaded portion 222; therefore, each first inner threaded portion 112 and each second inner threaded portion 222 can jointly form a complete spiral inner threaded portion.

In addition, each engagement portion 22 penetrates into each opening hole 11, and each guiding extension piece 23 is formed to extend in a direction away from each through hole. In addition, each terminal slab 21 is of a T-shape such that each terminal slab 21 and each of the two engagement shafts 221 jointly form a Y-shape. However, the present invention is not limited to such configuration only.

Furthermore, an outer side of each of the two engagement shafts 221 includes two locking pins 223 extended therefrom and locked onto each of the two locking slots 113 in order to allow each engagement portion 22 to be firmly penetrated into each opening hole 11.

Moreover, an inner side of each of the two engagement shafts 221 includes two protruding points 224 extended therefrom and arranged underneath each first inner threaded portion 222. In addition, a bottom end of each terminal slab 21 includes a protruding leg 212, and each protruding leg 212 protrudes outward and is exposed at the bottom surface 15. The protruding leg 212 is used for electrical connection with other electronic component parts.

As shown in FIG. 2 to FIG. 7, each screw 3 includes an outer threaded portion 31 engaged with each first inner threaded portion 112 and each second inner threaded portion 222 in order to allow each screw 3 to penetrate into each opening hole 11 and to be engaged with each engagement portion 22. Each screw 3 and each guiding extension piece 23 jointly clamp each cable 100 thereon. Furthermore, each screw 3 can be blocked and limited by each one of the two protruding points 224 in order to prevent the depth of the screw 3 engaged with the engagement portion 22 to be too great such that the cable 100 may be overly compressed.

As shown in FIG. 3 to FIG. 7, in exemplary states of use of the cable fastening terminal block 10 of the present invention, it utilizes the top end 211 of the terminal slab 21 having the guiding extension piece 23 extended therefrom. First, the cable 100 is used to penetrate into the through hole 12 and is placed on the guiding extension piece 23. Next, the screw 3 is rotated in order to allow the screw 3 to penetrate into the opening hole 11 and to be engaged with the engagement portion 22 until the screw 3 and the guiding extension piece 23 jointly clamp the cable 100 thereon. Consequently, the cable 100 can be firmly attached onto the terminal slab 21 in order to achieve the effect of electrical connection.

Furthermore, the top end 211 of the terminal slab 21 includes the guiding extension piece 23 extended therefrom; therefore, the contact area between the cable 100 and the terminal slab 21 is increased in order to prevent the condition of bending or rupture of the cable 100 due to the cutting by the terminal slab 21 caused by the overly thin thickness of the terminal slab 21. Consequently, the proper electrical connection between the cable 100 and the terminal slab 21 can be enhanced; thereby allowing the cable fastening terminal block 10 to have a stable electrical connection capability.

In addition, only small amount of component parts of the base 1, fastening terminal member 2 and screw 3 are required for the fastening operation of the cable 100; therefore, the objectives of material saving and cost reduction can be achieved.

Moreover, the screw 3 is engaged with the engagement portion 22 such that the cable 100 can be fastened (press-fit) tightly. In addition, since the contact area between the cable 100 and the terminal slab 21 is large, the clamping of the cable 100 by the screw 3 and the terminal slab 21 would not generate any bending or rupture of the cable such that the issue of damages of the cable 100 can be prevented and the effect of proper cable fastening can be enhanced.

In view of the above, the cable fastening terminal block of the present invention can achieve the expected objectives and overcome the drawbacks of known arts. In addition, the above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A cable fastening terminal block, used for at least one cable (100), and the cable fastening terminal block, comprising:

a base (1) having at least one opening hole (11) and at least one through hole (12) formed thereon from an external toward an internal thereof, the at least one opening hole (11) and the at least one through hole (12) arranged alternating from each other and connected to each other;

at least one fastening terminal member (2) received inside the base (1) and arranged corresponding to the opening hole (11) and the through hole (12); the fastening terminal member (2) having a terminal slab (21), and a top end (211) of the terminal slab (21) having an engagement portion (22) extended along the opening hole (11) in an axial direction thereof and a guiding extension piece (23) extended along the through hole (12) in an axial direction thereof; the cable (100) penetrating through the through hole (12) and being placed on the guiding extension piece (23); and at least one screw (3) penetrating through the opening hole (11) and engaged with the engagement portion (22); the screw (3) and the guiding extension piece (23) jointly clamping the cable (100) thereon, wherein the engagement portion (22) penetrates into the opening hole (11), and the guiding extension piece (23) is formed to extend toward a direction away from the through hole (12);

wherein the guiding extension piece (23) includes a concave inner surface (231), and the concave inner surface (231) is attached onto the cable (100);

wherein the engagement portion (22) includes two engagement shafts (221) extending from the top end (211) of the terminal slab (21) and penetrating into the opening hole (11); the two engagement shafts (221) are arranged at two sides of the guiding extension piece (23).

2. The cable fastening terminal block according to claim 1, wherein an inner wall of the opening hole (11) includes two protrusions (111) formed at two sides of the two engagement shafts (221); an inner side of the two protrusions (111) includes a first inner threaded portion (112), an inner side of the two engagement shafts (221) include a second inner threaded portion (222), the screw (3) includes an outer threaded portion (31) engaged with the first inner threaded portion (112) and the second inner threaded portion (222).

3. The cable fastening terminal block according to claim 2, wherein the inner wall of the opening hole (11) includes two locking slots (113), outer sides of the two engagement shafts (221) include two locking pins (223) locked onto the two locking slots (113).

4. The cable fastening terminal block according to claim 3, wherein the inner sides of the two engagement shafts (221) include two protruding points (224) extending therefrom and arranged underneath the first inner threaded portion (222) in order to allow the screw (3) to be blocked and limited by the two protruding points (224).

5. The cable fastening terminal block according to claim 4, wherein the base (1) includes a top surface (13) and a plurality of side surfaces (14); the opening hole (11) is formed on the top surface (13), and the through hole (12) is formed on one of the plurality of side surfaces (14).

6. The cable fastening terminal block according to claim 5, wherein the base (1) further includes a bottom surface (15); a bottom end of the terminal slab (21) includes a protruding leg (212); the protruding leg (212) protrudes outward and is exposed at the bottom surface (15).

7. The cable fastening terminal block according to claim 6, wherein the terminal slab (21) is of a T-shape, and the terminal slab (21) and the two engagement shafts (221) jointly form a Y-shape.

* * * * *